United States Patent [19]

Vick

[11] 3,967,479

[45] July 6, 1976

[54] KEY LOCK

[76] Inventor: Jerome Vick, 801 Lake Charm Drive, Oviedo, Fla. 32765

[22] Filed: June 25, 1974

[21] Appl. No.: 482,997

[52] U.S. Cl. ..... 70/276; 70/413; 70/422; 74/22 R; 200/44

[51] Int. Cl.[2] ..... E05B 47/00

[58] Field of Search ..... 70/276, 413, 422; 74/56; 200/44

[56] References Cited

UNITED STATES PATENTS

| | | | |
|---|---|---|---|
| 428,247 | 5/1890 | Fenner | 70/276 |
| 2,780,106 | 2/1957 | Lovequist | 74/22 R |
| 3,056,276 | 10/1962 | Allander | 70/276 |
| 3,444,711 | 5/1964 | Sedley | 70/276 |
| 3,602,020 | 8/1971 | Kajita | 70/276 |

*Primary Examiner*—Albert G. Craig, Jr.
*Attorney, Agent, or Firm*—Edwin E. Greigg

[57] ABSTRACT

A magnetic lock mechanism which may be used in conjunction with many devices such as a padlock, dead bolt door lock, conventional door lock, safety deposit box, safe doors, automobile doors, gas cap locks, ignition switch locks, a switch actuating device or others. A key having magnets, selectively oriented therein, line up magnetic tumbler pins location within the locking device. With the tumbler pins lined up, a member can be moved axially and then rotationally to actuate a driving member.

14 Claims, 8 Drawing Figures

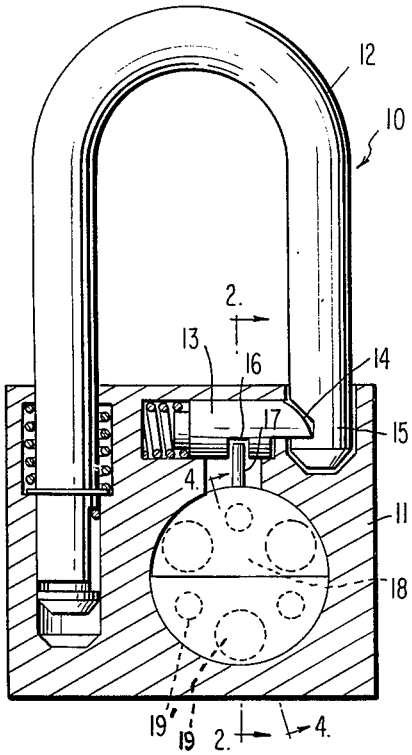
FIG. 1
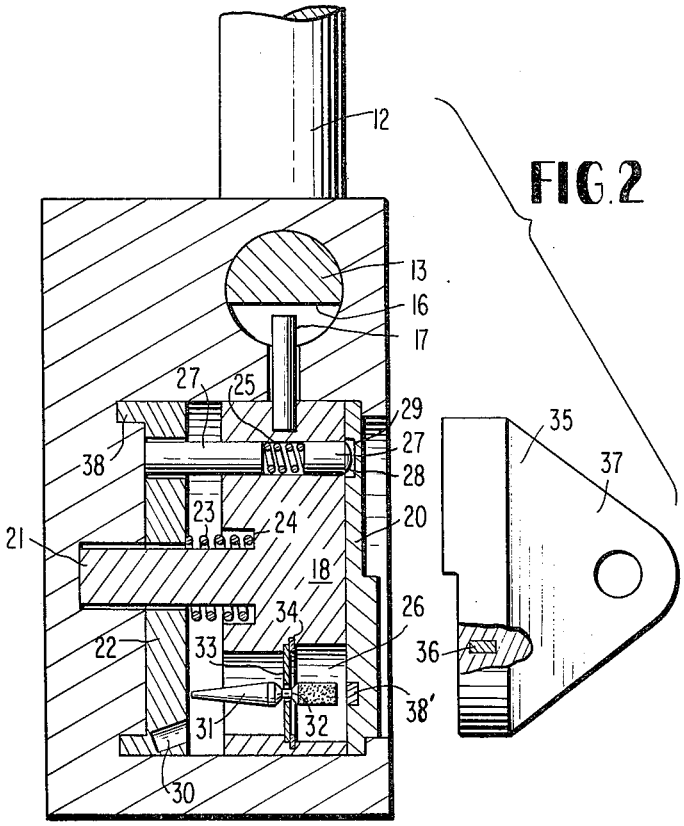
FIG. 2
FIG. 4
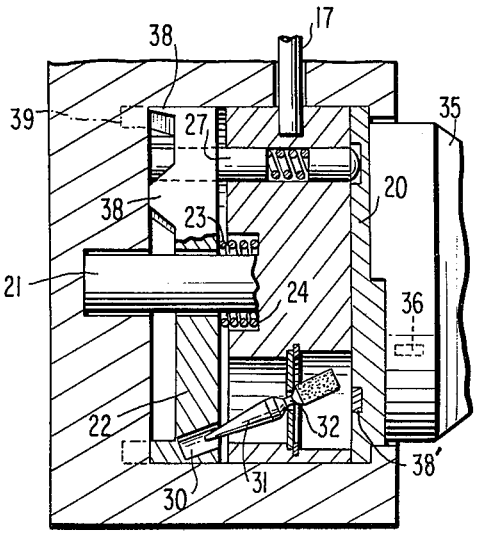
FIG. 3
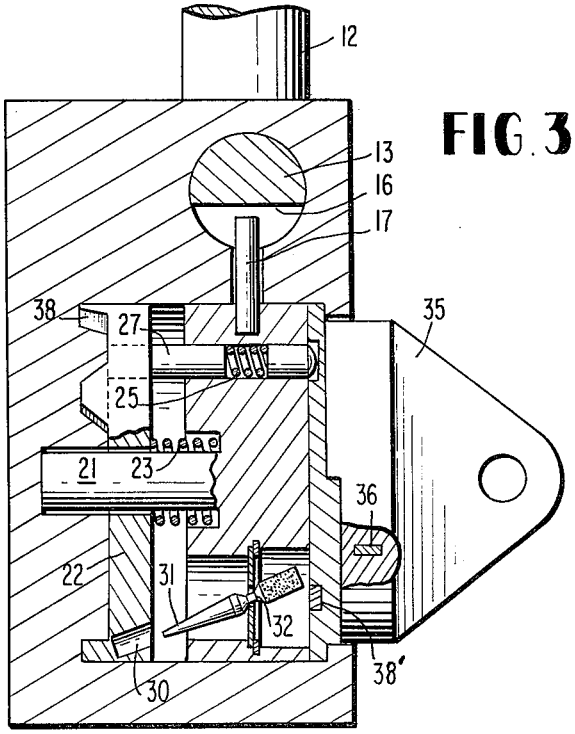

KEY LOCK

BACKGROUND OF THE INVENTION

The present invention relates generally to a key actuated mechanism, and while the following description refers primarily to a magnetic key actuated lock, the mechanism may be used for other purposes as set forth in the above abstract of the invention.

The present device is an improvement on such devices shown in Fenner, U.S. Pat. No. 428,247 and Allender, U.S. Pat. No. 3,056,276. In the earlier patent, and as best shown in FIG. 5, the tumblers are arranged to be magnetically actuated upon insertion of a key head and caused to swing about their fixed pivot points so as to be brought into alignment with the openings 30 thereby releasing the lock. In the later patent, the unlocking operation is also conducted by a magnetic key means which causes the metallic needles that are capable of being influenced by a magnetic field to float into proper alignment with apertures in a plate that is reciprocated toward the needles when the proper key means is used.

Thus the prior art shows magnetically positioned tumblers which are aligned with holes in a lock bolt to permit movement of the bolt with the alignment of the tumblers being accomplished by a magnetic key placed adjacent to the lock to align the tumblers with the openings in the bolt.

In the prior art referred to above, the magnets to actuate the magnetic tumblers are either aligned in a straight line, or are positioned, as in the case of Allander, in a rectangular array. In accordance with the present invention, the magnets are confined on the planar surface of a circular or cylindrical key which provides an even more infinite number of combinations than has heretofore been possible.

SUMMARY OF THE INVENTION

Accordingly, the principal object of this invention is to provide a locking device the mechanism of which is adapted to be influenced by a magnetic field upon assembly of a rotatable key with an exterior wall thereof.

Another object of the invention is to incorporate the locking mechanism into a shackle type lock of simplified and economical construction.

Still another object of the invention is to adapt the simplified locking mechanism disclosed herein to operate a bolt either by a rotary member or a sliding member.

Yet another object of the invention is to provide an operative assembly capable of actuating an electrical switch mechanism.

Accordingly, in view of the objects set forth it will be seen that the invention comprises a mechanism which may be used in conjunction with a padlock door lock or other device. The device includes an axially movable and rotatably movable member which can only be actuated when the magnetic tumblers are aligned with openings in the movable member.

The key may be of any desired shape and permits a multitude of combinations. For example, depending upon the number of tumblers involved, a variety of combinations of magnets in the key to conform with the tumblers may be used. The tumblers may be mounted to move in any position, or they may be pivotably mounted to move with a 90° angle.

Since the tumblers can only be aligned by a specific key, the possibility that the mechanism can be actuated by other means is remote.

Other objects and advantages of the present invention will be more readily apparent from a further consideration of the following detailed description of the drawings illustrating a preferred embodiment of the invention, in which:

DESCRIPTION OF THE DRAWINGS

FIG. 1 is an elevational view in section of a lock incorporating the present invention;

FIG. 2 is a sectional view of FIG. 1, taken along the lines 2—2, showing the key and tumbler pins not in alignment;

FIG. 3 is a sectional view similar to FIG. 2, wherein the key and tumbler pins are in alignment;

FIG. 4 is a vertical sectional view of the device of the present invention wherein the actuating member is aligned with the tumbler pins;

DESCRIPTION OF THE PREFERRED EMBODIMENT

Figure 7:
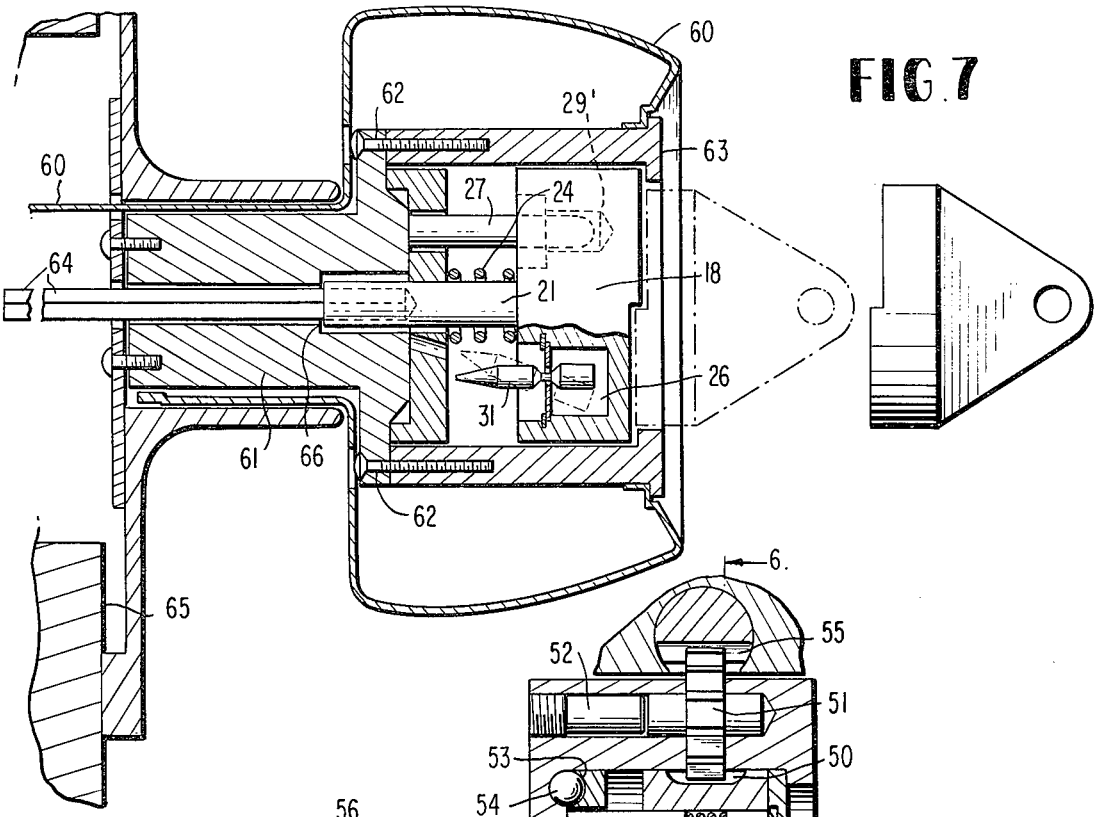
FIG. 7 is an elevational view, in section, of the inventive concept applied to a door handle.

Turning now to FIG. 1, there is shown a padlock 10 having a body portion 11 which includes a shackle 12 that is retained in a locked position by a spring biased bolt 13 which cooperates with an undercut portion 14 in the free end of shackle 12 as shown. The bolt 13 is notched in its lower surface as at 16 and arranged to receive a member 17 connected to a rotational locking member 18. Upon rotation of the disc-like locking member 18, the bolt 13 is moved counter-clockwise to release the shackle 12.

As shown in the elevational section view of FIG. 1, a series of circular lines in phantom, denoted 19 in this view, depict the coordinated arrangement of magnets that are positioned within the rotatable member 18 and lie flush with the interior planar surface of rotary release member 20 thereof, as shown. The smaller circular lines 19' depict the cylindrical slide ways for pins 27.

Referring now to FIG. 2, the locking member 18 is provided with an axially disposed rearwardly extending integral pin 21 adapted to pass through the reciprocable and oscillatable annulus 22 and to rotate therewith for reasons that will become apparent later herein.

The rotatable member 18 rotates in the lock housing and is arranged to abut against the over torque release member 20 and away from the perforated annulus 22 by pin 21. Spring member 23 biases annulus 22 axially to the left away from rotatable member 18 such as to engage the cam teeth with the cam ways when the key is turned to lock the mechanism.

FIG. 2 also clearly discloses that the rotational member 18 is provided with a plurality of apertures 25 and 26 some of which, as shown in this view, support oppositely disposed spring urged pin means 27—27 the terminus of the rearwardly projecting pin 27 being received in a perforation in the annulus and its forwardly projecting counterpart which has a rounded head being received in a recess 29 of over torque rotary release member 20 which operates in the following manner: member 20 is connected to 18 by a spring biased member 27 which is so biased that over torquing with an improper key or some other unauthorized mechanical torquing device would cause pin 27 to move axially out of recess 28 permitting the over torquing release member 20 to rotate, freeing it from rotatable member 18 and thus, not effect, nor unlock, but to protect the internal locking mechanism from damage.

As also shown in FIG. 2 annulus 22 includes an angularly disposed aperture 30 which is arranged to be aligned with the pointed end of the floating tumbler pin 31, as will now be explained.

The tumbler pins 31, one only of which is shown in the drawings, have a constricted area 32 that is supported in an apertured plate 33 which in turn is secured within the wall bounding the aperture 26 by an annular expansible spring lock member 34.

Turning now to FIG. 3, it will be noted that the key 35 which has an array of magnetized portions 36 (one shown) which it is to be understood are arranged to open the lock described will be gripped by its handle portion 37 and brought into contact with the front face of the rotatable member 20. Also, it will be observed that the front face of member 20 and the front wall of the key 35 are formed complementally to permit the key to turn the locking mechanism to disengage the bolt all of which will be now described by referring to FIG. 4.

In FIG. 4 the key is shown in contact with the front wall of the rotary member 20 and the turning operation has begun to take place since it can be seen that the perforated annulus 22 has moved forwardly in the lock housing so that the floating tumbler pin 31 can be received in the aperture 30.

By referring to FIG. 3 it will be noted first that the key 35 has been placed in proper position to perform the unlocking function and also that in this view there is shown in cross-section at 38 several of a plurality of integral camming teeth that extend rearwardly from the annulus and are received in a circularly disposed camway 39 in the rear of the lock housing, however, in this view the circular camway is not shown and reference is thus now made to FIG. 4 for that purpose.

In FIG. 4 the person holding the key 35 has now begun to turn it to the left (FIG. 1) and since all of the tumbler pins 31 are now in proper alignment with the apertures 30 and the pins 27—27 are in driving relation with the annulus 22 the cam teeth 38 will slide upwardly on the camway and the entire lock assembly will begin to rotate so that the bolt can be extracted from the latching means.

Figure 5:
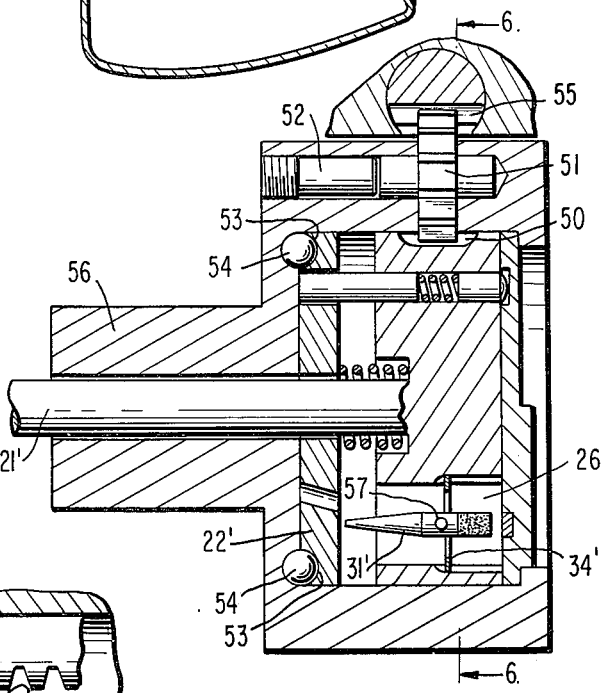
FIG. 5 is an elevational view, in section, of the mechanism of the present invention wherein gear drive means are employed.

Turning now to the embodiment of FIG. 5, it will be noted from a comparison of this view with the earlier described views that the periphery of the rotatable member 18 includes an array of teeth 50 that are arranged to cooperate with a small gear 51 suitably held in rotatable position within the lock housing by a set screw 52, as shown.

In this embodiment, as distinguished from the cam teeth 38 and circular camway 39 as shown in FIGS. 3 and 4, it is revealed that the perforated annulus 22' includes suitable depressions 53—53 into which balls 54—54 are seated in complemental depressions in the lock housing. The teeth of gear 51 cooperate with the reciprocable rack 55 for actuating a bolt. Also, in FIG. 5 it will be noted that the axial integral extension 21' projects through a collar 56 and from the rear wall of the lock housing and may be associated with various mechanisms as will be described later.

Also, in FIG. 5 the tumbler pin 31' does not float as explained earlier herein relative to the first embodiment, but rather is supported by a pair of arms 57—57 (FIG. 6) that are rotatably associated with a circular expansible spring member 34' that is received in the wall bounding the opening 26'.

Figure 6:
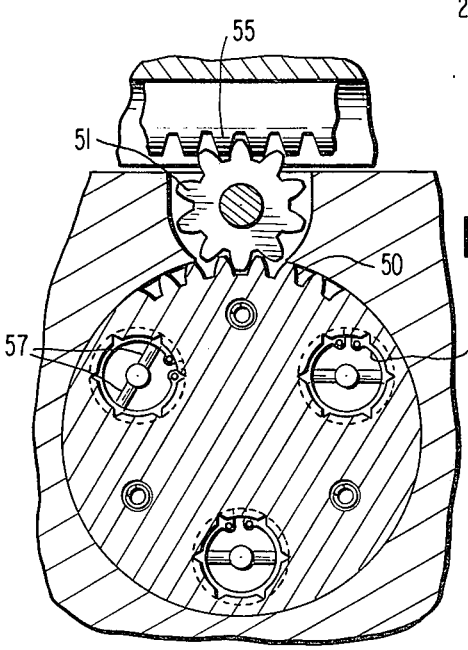
FIG. 6 is a sectional view of the present invention taken along the lines 6—6 of FIG. 5.

In view of the foregoing description it is believed that it will be apparent from an examination of the structure illustrated in FIGS. 5 and 6 that there is a distinct similarity of operation of the respective elements of this embodiment of the invention when compared with those shown in FIGS. 3 and 4.

Turning at this time to FIG. 7, there is shown a generally conventional door knob and escutcheon set into which has been assembled the magnetically actuated locking elements comprising this inventive concept. In this view the knob 60 is perforated axially therethrough and adapted to accommodate in the rearmost opening therein an elongated tubular member to the front of which is integrally formed an annulus that is provided adjacent to its edge portion with apertures for a purpose that will be apparent. Preparatory to assembling the locking elements into the knob 60 the sleeve element 63 forms a housing for the rotary member 18 (See FIGS. 1 and 2) thereafter the spring 24 is placed over the axially apertured stem 21 and pin members 27 are inserted into the bore 29', the floating tumbler pins 31 having already been assembled into the recess 26 in the rotatable member 18 as explained earlier herein. Thereafter, pin 21 which forms an extension of 18, abuts against shoulders 66 of the end wall member 61. The end wall member 61 is securely fastened to sleeve 63 by screws 62, only two of which are shown, to complete the lock assembly. Bar 64, being forced into the recess of 21 can then be used to drive any mechanism as will be discussed hereinafter.

A drivable member 64 of suitable exterior configuration is now inserted into the axial aperture in stem 21 and the entire device is ready for entry into an aperture in a door 65.

In view of the simplicity of the concept of adapting gears and/or oscillatable levers to the rod means 64 no further description would seem to be required since those skilled in the art will be aware of the adaptations possible in the light of this disclosure.

As shown in various views of the drawings in this application, the release member 20 carries a metal slug 38' on its inner surface. This slug is axially aligned with the tumblers 31 to maintain the tumblers parallel to the axis of the lock housing when the key is not in use. This has two advantages. One, it prevents unauthorized keys containing iron slugs only from deflecting the tumbler pins, and the other, it aligns the tumbler pins parallel to the axis of the lock which provides minimum clearance between the tumbler pins and the annulus 22. The iron slug would be of the type of material which provides the minimum hysteresis or residual magnetism. The alignment process is provided by the attraction of the magnetized end of the tumbler pins to the iron slug.

Figure 8:
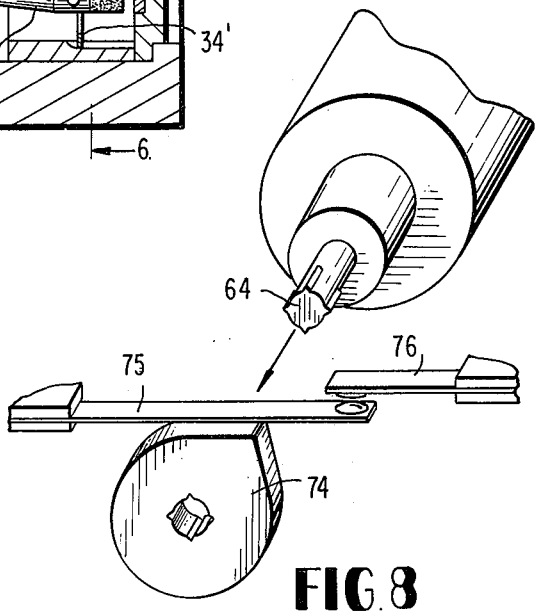
FIG. 8 is an exploded view illustrating one type of electrical switch that may be actuated by the lock of the present invention.

Further, insofar as the concept of assembling an electrically actuated alarm switch with the bar member 64 is concerned, suffice it to say that it is considered to be within the scope of this disclosure that any form of electrically operable alarm means that can be caused to function by a slight inadvertent or unauthorized rotary motion of the locking mechanism can cause the alarm to become operative. For example, a cam member 74 could be associated with bar member 64 and arranged to cooperate with one arm 75 of a switch means and maintain it in a disengaged condition relative to contact 76. It will be apparent that if an unauthorized individual attempts to open the latch by turning the rotary member the contacts will be closed to sound an alarm. Also, conceivably in lieu of the switch structure shown in FIG. 8, a gear (not shown) could be associated with the terminus of the bar member to actuate either a rack or other operable means complemental thereto. Further, it will be apparent that the bar member could also have attached thereto a lever which extends normal to the bar, said lever thus being pivotal through an arc of limited extent by rotation of the knob 60 to actuate a door latch, etc. In addition, a burglar alarm switch could be operated by the bar member by mounting thereon a suitable insulative carrier member arranged to support a metallic contact element having generally oppositely extending leg elements. Adjacent to the carrier within the confines of the door lock mechanism could be positioned spaced electrical contact elements which form part of an electrical circuit. If an attempt is made by an intruder to turn the knob of the door to force the lock mechanism, the rotation of the knob and the resultant rotary movement of the insulative carrier member would bring the metallic contact into engagement with the spaced electrical contact elements to close the circuit and sound the alarm.

The type of switch illustrated and described above is only suggestive of and not limiting as to various electrical switch means that may be associated with the bar member 64, all of which will be apparent to those skilled in this art.

While the particular magnetic mechanism herein shown and described in detail are fully capable of attaining the objects and advantages stated, it is understood that they are illustrative of the preferred embodiments of the invention and no limitations are intended to the details of the mechanism herein shown other than as defined in the appended claims.

What is claimed is:

1. A magnetically actuatable lock assembly including a housing, first rotatable means in said housing, second rotatable means having front and rear walls, said front wall being in juxtaposition relative to said first rotatable means, overload release means joining said first and second rotatable means for concurrent rotation serving to prevent unauthorized lock operation, annular means including a plurality of apertures therein spaced from said rear wall, said last named means having further means complemental to means within said housing serving to cause reciprocation of said annular means upon rotation of said annular means, magnetic tumbler pin means associated with said second rotatable means, means drivingly associating said second rotatable means and said annular means for unitary rotary movement said tumbler means normally engaging said second rotatable means and said annular means in such a manner as to prevent said reciprocation and thus prevent said unitary rotary movement, and magnetic key means for aligning said tumbler pin means with at least some of said apertures in said annular means and drivably interlocking with said first rotatable means, whereby upon rotation of said magnetic key means said annular means will advance toward said second rotatable means to cause the tumbler pin means to be received within said apertures in said annular means to permit rotation of said annular means and unlatching of said lock.

2. A magnetically actuatable lock assembly as claimed in claim 1, in which the annular means is maintained in spaced relation relative to said second rotatable means by spring means.

3. A magnetically actuatable lock assembly as claimed in claim 2, in which the spring means encompasses axially disposed rearwardly extending means that penetrate said annular means.

4. A magnetically actuatable lock assembly as claimed in claim 1, in which the means drivingly associating said first and second rotatable means are spring urged in opposite directions.

5. A magnetically actuatable lock assembly as claimed in claim 1, in which the second rotatable means has drivingly associated therewith means for releasing a latch means.

6. A magnetically actuatable lock assembly as claimed in claim 5, in which the means for releasing said latch means includes an oscillatable pin means.

7. A magnetically actuatable lock assembly as claimed in claim 5, in which the means for releasing said latch means includes a gear driven rack assembly.

8. A magnetically actuatable lock assembly as claimed in claim 1, in which the tumbler pins are arranged to float in a support means.

9. A magnetically actuatable lock assembly as claimed in claim 1, in which the tumbler pins are arranged to pivot in one plane in a support means.

10. A magnetically actuatable lock assembly as claimed in claim 1, in which the annular means includes cam means complemental to a camway provided in said lock housing.

11. A magnetically actuatable lock assembly as claimed in claim 1, in which ball means are interposed between the annular means and said lock housing.

12. A magnetically actuatable lock assembly as claimed in claim 1, in which iron slugs are associated with said first rotatable means.

13. A magnetically actuatable lock assembly as claimed in claim 1, in which the second rotatable means has drivingly associated therewith an electric switch means.

14. A magnetically actuatable lock assembly as claimed in claim 1, in which the key means includes a surface area complemental to a wall on said first rotatable means.

* * * * *